US005797571A

United States Patent [19]

Brophy

[11] Patent Number: 5,797,571

[45] Date of Patent: Aug. 25, 1998

[54] COMBINED LADDER HOOK AND BRACKET ASSEMBLY

[76] Inventor: Hugh Joseph Brophy, 9 Garrison Ave., West Somerville, Mass. 02144-1710

[21] Appl. No.: 716,478

[22] Filed: Sep. 19, 1996

[51] Int. Cl.[6] ..... F06C 7/14

[52] U.S. Cl. ..... 248/210; 248/211; 182/129

[58] Field of Search ..... 182/129; 248/210, 248/211, 238

[56] References Cited

U.S. PATENT DOCUMENTS

| | | | |
|---|---|---|---|
| 451,893 | 5/1891 | Campbell | 182/129 |
| 1,115,420 | 10/1914 | Farnham | 248/210 |
| 2,174,891 | 10/1939 | Maran | 248/210 X |
| 2,439,185 | 4/1948 | Patt . | |
| 2,439,430 | 4/1948 | Hurd | 248/210 X |
| 2,453,189 | 6/1948 | Bogut . | |
| 2,519,980 | 8/1950 | Renz | 248/211 |
| 3,001,751 | 5/1961 | Bozik . | |
| 3,809,351 | 5/1974 | Bravo et al. . | |
| 3,822,847 | 7/1974 | Emmons | 248/210 |
| 3,887,034 | 6/1975 | Sawatzky | 182/129 |
| 4,433,822 | 2/1984 | Caggiano . | |
| 4,862,994 | 9/1989 | Hughes, Sr. | 182/129 X |
| 4,979,710 | 12/1990 | Baldwin | 248/210 |
| 5,052,581 | 10/1991 | Christ et al. | 248/211 X |
| 5,191,954 | 3/1993 | Ledford | 182/129 |

FOREIGN PATENT DOCUMENTS

| | | | |
|---|---|---|---|
| 779845 | 4/1935 | France | 248/210 |
| 653616 | 11/1937 | Germany | 182/129 |
| 2274132 | 7/1994 | United Kingdom | 182/129 |

*Primary Examiner*—Daniel P. Stodola
*Assistant Examiner*—Richard M. Smith
*Attorney, Agent, or Firm*—Iandiorio & Teska

[57] ABSTRACT

A combined ladder hook and bracket assembly including a bracket section with a first face angled with respect to a second face, a pair of opposing rung engaging gaffs on the distal ends of the bracket section and an arm interconnected with the bracket section. The arm includes a hook for attaching an article to the arm. The combined ladder hook and bracket assembly attaches to a ladder and a paint can or a tool attaches to the hook.

9 Claims, 3 Drawing Sheets

COMBINED LADDER HOOK AND BRACKET ASSEMBLY

FIELD OF INVENTION

This invention relates to a combined ladder hook and bracket assembly for attaching a paint can or other article to a ladder in a secure fashion.

BACKGROUND OF INVENTION

Ladders are often used when painting or working on the surfaces of a house or building. A painter typically uses one hand to hold onto the ladder and paints with the other hand. As a result, the painter has no free hands to hold a paint can. Many ladder attachment devices have been developed to conveniently position the paint can on the ladder in relation to the painter. Some devices, like the device shown in U.S. Pat. No. 2,453,189, are easily attached to a ladder. However, a device which is easily attached to the ladder may also become easily detached from the ladder. Serious mishaps can occur if a paint can detaches and falls from a ladder.

Other ladder hooks have been developed to securely fasten a paint can to a ladder. However, these devices are usually inconvenient to use because they are bulky and require excessive time to connect and disconnect them to the ladder. Some devices, like the device shown in U.S. Pat. No. 4,433,822, inhibit a person from moving up or down the ladder, thereby causing a safety concern.

When a ladder is positioned against a wall at an angle, some prior art ladder attachment devices also position the paint can at an angle. See, for example, U.S. Pat. No. 3,809,351 and U.S. Pat. No. 4,433,822. These attachment devices cause the contents of an attached paint can to also be set at the same angle, thereby reducing the paint can's capacity. U.S. Pat. No. 3,001,751 shows a device which allows the paint can holder to be angularly rotated but this device must be adjusted if the ladder is moved and the paint can's contents will spill if the angle of the ladder changes.

Most importantly, the currently available ladder hooks do not adequately secure the paint can to the ladder. If a painter cannot move the ladder with an attached paint can he must disconnect the paint can, move the ladder, and then again connect the paint can to the ladder. Other ladder hooks are bulky, expensive, and generally inconvenient to use.

SUMMARY OF INVENTION

It is therefore an object of this invention to provide a combined ladder hook and bracket assembly.

It is a further object of this invention to provide such combined ladder hook and bracket assembly which is simple in design and low cost.

It is a further object of this invention to provide such combined ladder hook and bracket assembly which is quickly attachable and detachable to a ladder.

It is a further object of this invention to provide such combined ladder hook and bracket assembly which can be fastened to a ladder in a safe and secure manner.

It is a further object of this invention to provide such combined ladder hook and bracket assembly which allows the contents of a paint can to remain at an even level.

It is a further object of this invention to provide such combined ladder hook and bracket assembly which firmly secures a paint can or other article to a ladder even while the ladder is being moved from place to place at the worksite.

It is a further object of this invention to provide such combined ladder hook and bracket assembly which is collapsible for easy and compact storage and transportation.

This invention results from the realization that a paint can or other article can be securely attached to a ladder, even as the ladder is moved from place to place, by the combination of a ladder bracket which engage the rungs of a ladder and a hook portion which is secured to both the bracket and the ladder.

This invention features a combined ladder hook and bracket assembly including a bracket section having a first face angled with respect to a second face. The bracket section includes a pair of opposing rung engaging gaffs on the distal ends of the bracket section. An arm interconnects with the bracket section and the arm includes hook means for attaching an article, such as a paint can or bucket to the arm.

The hook means typically includes a swivel hook attached to an eyelet. To further secure the combined ladder hook and bracket assembly to a ladder, the bracket section further includes an intermediate rung engaging gaff connected between the opposing gaffs. The intermediate gaff is preferably adjustable.

The second face of the bracket section preferably has at least one bearing for receiving the arm. The arm also includes a rung engaging gaff for securing the arm to the ladder. The rung engaging gaff of the arm preferably has a radius large enough such that a portion of the gaff is received through the bearing to facilitate folding the arm parallel to the bracket section.

This invention also features a combined ladder hook and bracket assembly comprising a bracket section having a first face angled with respect to a second face. The second face includes at least one bearing, and there are a pair of opposing rung engaging gaffs on the distal ends of the bracket. An adjustable intermediate rung engaging gaff is located between the opposing gaffs. An arm including a hook means on one end thereof and a rung engaging gaff on the other end thereof passes through the bearing and the rung engaging gaff has a radius large enough such that a portion of the gaff can be received through the bearing to facilitate folding the arm parallel to the bracket section.

DISCLOSURE OF PREFERRED EMBODIMENT

Other objects, features and advantages will occur to those skilled in the art from the following description of a preferred embodiment and the accompanying drawings, in which.

Figure 1:
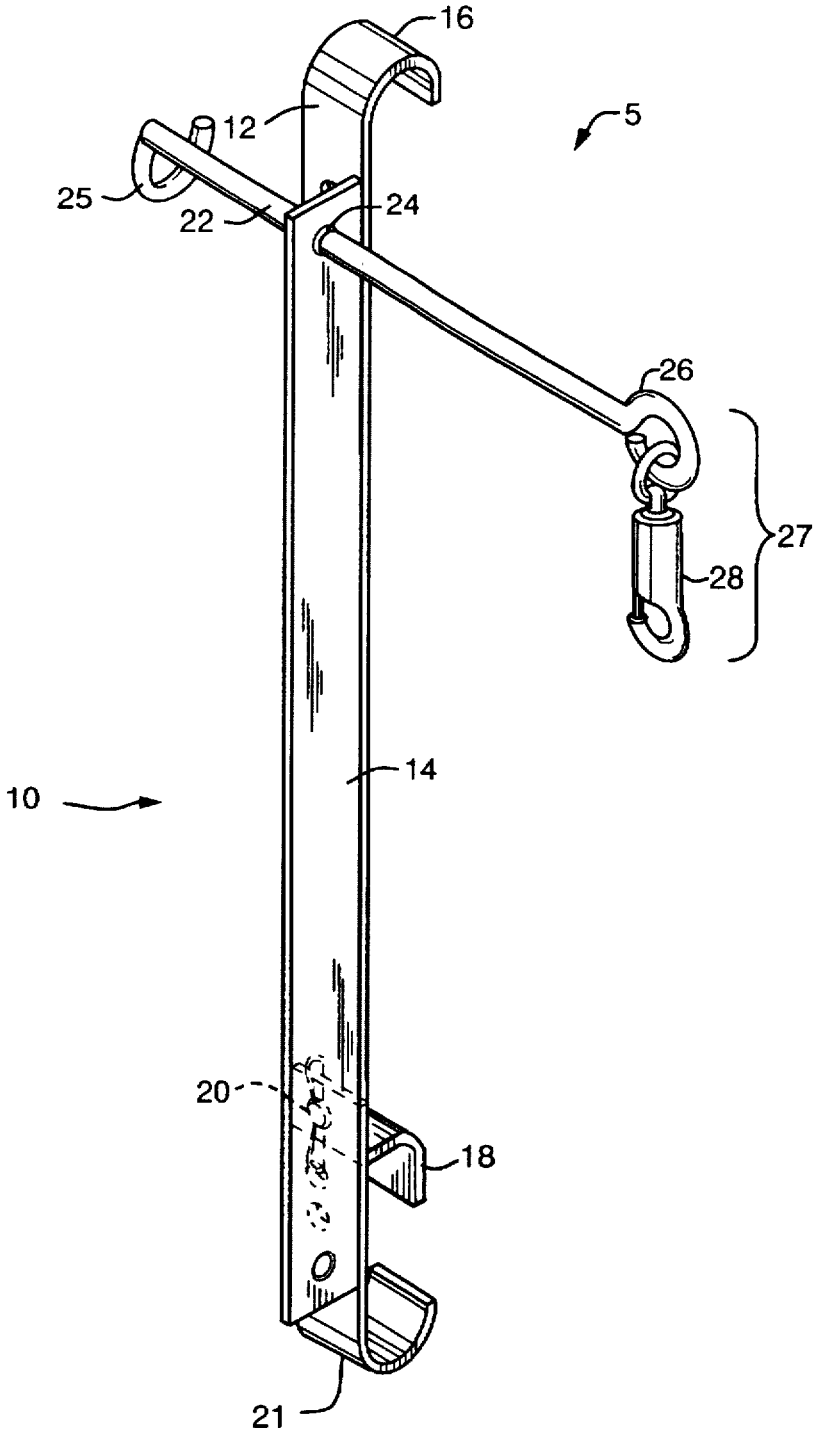
FIG. 1 is a schematic view of the ladder hook and bracket assembly of this invention.

Combined ladder hook and bracket assembly 5, FIG. 1, including bracket section 10 and interconnecting arm 22. Bracket section 10 includes first face 12 angled with respect to second face 14 and a pair of opposing rung engaging gaffs 16 and 21 on the distal ends of the bracket section 10. Arm 22 is interconnected with the bracket section 10 via bearing 24. Arm 22 includes hook means 27 for attaching an article such as a paint can or bucket to the arm 22. In a preferred embodiment, hook means 27 includes swivel hook 28 and eyelet 26.

For increased stability of bracket section 10, intermediate rung engaging gaff 18 is located between opposing gaffs 16 and 21 to provide an additional fastening means for fastening combined ladder hook and bracket assembly 5 to the ladder. Intermediate gaff 18 is adjustable to allow the combined ladder hook and bracket assembly 5 to be safely secured to a ladder.

In a preferred embodiment, arm 22 also includes a rung engaging gaff 25. Gaff 25 engages a ladder rung and the weight of the article, attached to hook 28, acts as a counter weight thereby biasing gaff 25 to the ladder rung.

Figure 3:
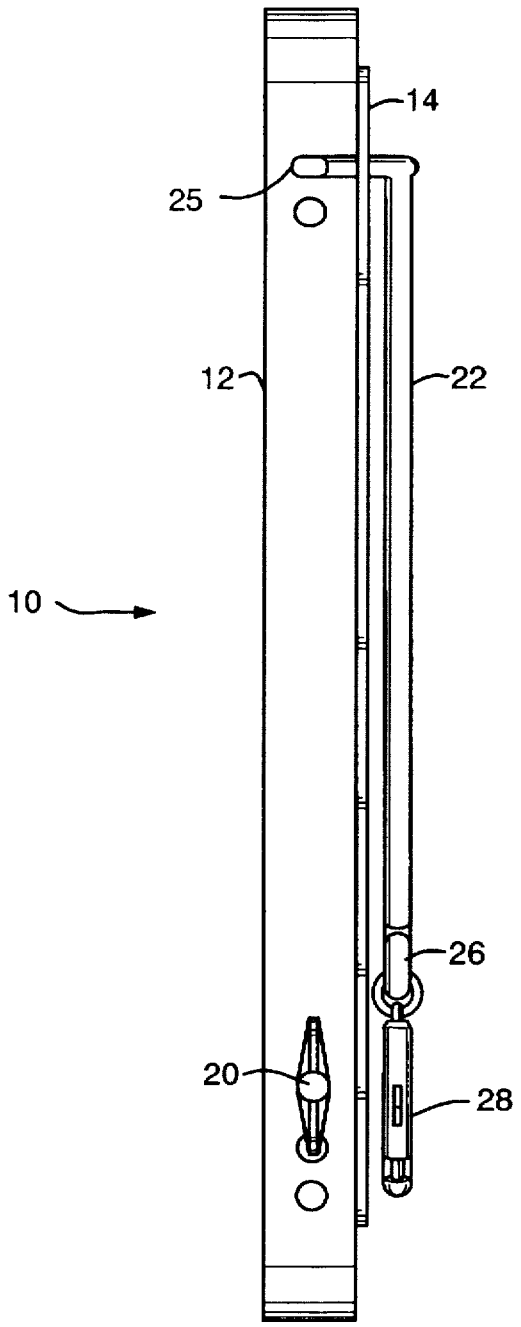
FIG. 3 is a schematic view of the ladder and bracket assembly of this invention in the collapsed position for storage and transportation.

As shown in FIG. 3, gaff 25 of arm 22 preferably has a radius large enough such that a portion of gaff 25 is receivable through bearing 24 to facilitate folding arm 22 parallel to bracket section 10. When arm 22 is folded down parallel to bracket section 10, combined ladder hook and bracket assembly 5 can be easily stored or transported.

Figure 2:
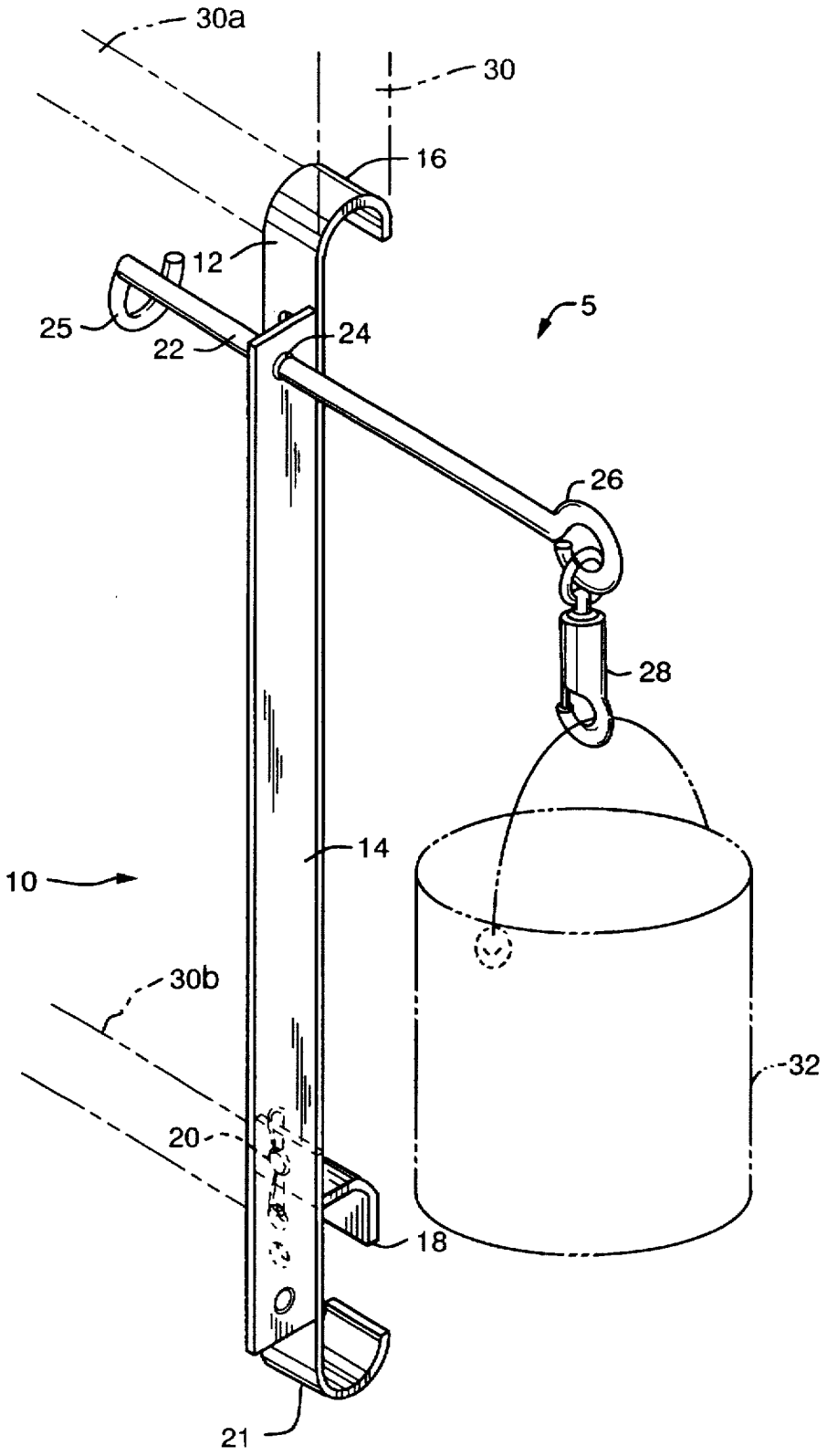
FIG. 2 is a schematic view of the ladder hook and bracket assembly of this invention attached to a ladder with a paint can attached to the swivel hook.

The combined ladder hook and bracket assembly of this invention is designed to fit on a runged ladder 30 as shown in FIG. 2. Upper gaff 16 and intermediate gaff 18 engage ladder rungs **30*a* and 30*b* of ladder 30. Intermediate gaff 18 provides an additional fastening means to secure the assembly to ladder 30. Intermediate gaff 18 is adjustable and is positioned onto ladder rung 30*b* and wing nut 20 is tightened to fasten assembly 5 to ladder 30. Arm 22 includes rung engaging gaff 25 on one end and eyelet 26 with attached swivel hook 28 on the other end. Arm 22 interconnects with bracket section 10 by passing through bearing 24 of the bracket section 10. Articles such as a paint can 32 or tools (not shown) can be conveniently attached to the assembly by the use of swivel hook 28. In addition, assembly 5** is also designed to work on either the left or the right side of a ladder. The arm can be removed and reversed to allow the attached article to hang on either the left or right side of the ladder. Thus, the combined ladder hook and bracket assembly of this invention is simple in design and low cost. It can be quickly attached or detached and yet secure and stable unlike prior art devices. The swivel hook on the distal end of the arm allows an attached article to freely hang, thereby assuring that the paint can remains at an even level. In addition, since the bracket is securely fastened to the ladder, the ladder can be moved with the attached bracket from place to place at the worksite. Finally, the combined ladder hook and bracket assembly of this invention is collapsible for easy and compact storage or transportation of the assembly.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. A combined ladder hook and bracket assembly comprising:

a bracket section including a first face angled with respect to a second face;

a pair of opposing rung engaging gaffs on opposite distal ends of said bracket section; and a rigid arm pivotally interconnected with one face of said bracket section so as to enable said arm to pivot into a position essentially parallel to said bracket section, said bracket section including an intermediate rung engaging gaff disposed between said opposing gaffs, said arm including hook means on one end thereof for attaching an article to said arm and a rung engaging gaff on the other end thereof.

2. The combined ladder hook and bracket assembly of claim 1 further including means for adjusting said intermediate gaff with respect to said bracket section.

3. A combined ladder hook and bracket assembly comprising:

a bracket section including a first face angled with respect to a second face;

a pair of opposing rung engaging gaffs on opposite distal ends of said bracket section; and a rigid transverse arm pivotally interconnected with said bracket section so as to enable said arm to pivot into a position essentially parallel to said bracket section, said bracket section including an intermediate rung engaging gaff disposed between said opposing gaffs, said arm including an eyelet and a swivel hook attached to said eyelet on one end thereof for attaching an article to said arm and a rung engaging gaff on the other end thereof.

4. The combine ladder hook and bracket assembly of claim 3 further includes means for adjusting said intermediate gaff with respect to said bracket section.

5. A combined ladder hook and bracket assembly comprising:

a bracket section including a first face and a second face including at least one bearing;

a pair of opposing rung engaging gaffs on opposite distal ends of said bracket section; and a rigid arm, receivable by said bearing, pivotally interconnected with said bracket section so as to enable said arm to pivot to a position essentially parallel to said bracket section, said bracket section including an intermediate rung engaging gaff disposed between said opposing gaffs, said rigid arm including hook means on one end thereof for attaching an article to said arm and a rung engaging gaff on the other end thereof.

6. The combined ladder hook and bracket assembly of claim 5 further including means for adjusting said intermediate gaff with respect to said bracket section.

7. A combined ladder hook and bracket assembly comprising:

a bracket section including a first face angled with respect to a second face, said second face including at least one bearing;

a pair of opposing rung engaging gaffs on opposite distal ends of said bracket;

an intermediate rung engaging gaff disposed between said opposing gaffs;

means for adjusting said intermediate gaff; and an arm including hook means on one end thereof and a rung engaging gaff on the other end thereof, wherein said arm passes through said bearing and said rung engaging gaff has a radius large enough such that a portion of said gaff can be received through said bearing to facilitate folding said arm parallel to said bracket section.

8. A combined ladder hook and bracket assembly comprising:

a bracket section including a first face angled with respect to a second face, said second face including at least one bearing;

a pair of opposing rung engaging gaffs on opposite distal ends of said bracket section; and an arm interconnected with said bracket section, said arm receivable through said bearing, said arm including hook means on one end thereof for attaching an article to said arm and a rung engaging gaff on the other end thereof, said rung engaging gaff of said arm having a radius large enough such that a portion of said gaff can be received through said bearing to facilitate folding said arm parallel to said bracket section.

9. A combined ladder and bracket assembly comprising:

a bracket section including a first face and a second face, said second face including at least one bearing;

a pair of opposing rung engaging gaffs on opposite distal ends of said bracket section; and an arm receivable by said bearing including hook means on one end thereof for attaching an article to said arm and a rung engaging gaff on the other end thereof, said rung engaging gaff of said arm having a radius large enough such that a portion of said gaff can be received through said bearing to facilitate folding said arm parallel to said bracket section.

* * * * *